US005092592A

United States Patent [19]

FitzMaurice

[11] Patent Number: 5,092,592

[45] Date of Patent: Mar. 3, 1992

[54] SPORTS TRAINING DEVICE

[76] Inventor: Thomas R. FitzMaurice, 86 Peaceable St., Ridgefield, Conn. 06877

[21] Appl. No.: 596,458

[22] Filed: Oct. 12, 1990

[51] Int. Cl.[5] ..... A63B 61/00

[52] U.S. Cl. ..... 273/29 A; 273/183 B; 273/188 R; 273/189 R; 70/16

[58] Field of Search ..... 273/26 C, 29 A, 183 B, 273/188 R, 189 R; 128/846, 870, 878, 882, 892, 869; 119/97.2, 96; 70/16, 17, 18, 24, 25, 26, 28, 29, 34, 35, 38 A, 38 B, 38 C, 41

[56] References Cited

U.S. PATENT DOCUMENTS

| | | | |
|---|---|---|---|
| 650,656 | 5/1900 | Baabe | 273/189 R |
| 1,279,924 | 9/1918 | Smith . | |
| 2,093,153 | 9/1937 | McCarthy . | |
| 2,808,267 | 10/1957 | Heaton . | |
| 2,809,043 | 10/1957 | Brouwer . | |
| 3,604,307 | 6/1970 | Vono | 272/67 |
| 3,621,681 | 11/1971 | Mikesic | 70/16 |
| 3,698,389 | 10/1972 | Guedel . | |
| 3,820,794 | 6/1974 | Inoue | 273/183 R |
| 3,937,465 | 2/1976 | Roland . | |
| 3,970,316 | 7/1976 | Westmoreland . | |
| 4,030,732 | 6/1977 | Vincent . | |
| 4,173,974 | 11/1979 | Belliveaeu | 70/16 |
| 4,191,373 | 3/1980 | Lancellotti . | |
| 4,209,169 | 6/1980 | Roberts . | |
| 4,254,953 | 4/1981 | Marchetti . | |
| 4,273,336 | 6/1981 | Larkey . | |
| 4,318,546 | 3/1982 | Chen | 273/188 R |
| 4,367,872 | 1/1983 | Langston . | |
| 4,377,284 | 3/1983 | Okerlin . | |
| 4,445,686 | 5/1984 | Daughtery . | |
| 4,575,089 | 3/1986 | Corbett . | |
| 4,875,677 | 10/1989 | Tetrault . | |
| 4,896,887 | 1/1990 | Cable . | |
| 4,911,728 | 3/1990 | Rigel . | |

FOREIGN PATENT DOCUMENTS

| | | | |
|---|---|---|---|
| 1049580 | 2/1979 | Canada . | |
| 2201603 | 9/1988 | United Kingdom | 273/183 B |

*Primary Examiner*—Theatrice Brown
*Attorney, Agent, or Firm*—Pennie & Edmonds

[57] ABSTRACT

A sports training device is described for securing the wrists and arms of a player. It comprises three elongated members, the first two being centered and pivotally mounted on the third and spaced apart a distance slightly less than the player's forearms. Each of the first two members can rotate in substantially the same plane about one of two parallel axes perpendicular to the axis of the third member. One of the first two members has at its two ends means for securing it to the player's wrists; and the other has at its two ends means for securing it to the player's arms near the elbow. When a player's wrists and arms are secured by this device, he is essentially forced to stand sideways to hit the tennis ball. At the same time, since the training device allows the player to shift the position of his left wrist and arm longitudinally relative to his right wrist and arm by rotating the first two members relative to the third, the player is able to move his shoulders and upper body properly in swinging at the tennis ball.

10 Claims, 3 Drawing Sheets

SPORTS TRAINING DEVICE

BACKGROUND AND SUMMARY OF THE INVENTION

This relates to a training device for use in sports in which a player swings a racquet, stick, club or the like. It is especially useful in sports such as tennis and will be described in that context.

It is generally agreed that the proper way to hit a tennis ball with a ground stroke is to stand sideways with respect to the direction from which the ball is coming, to step forward on the leg closer to the ball, thereby transferring one's weight to that foot, and to swing the racquet so as to meet the ball.

The present invention forces the player to hit a tennis ball in this fashion by securing together his wrists and elbows. With the wrists and elbows secured, the player is forced to stand sideways to hit the ball and he soon learns that the most effective swing can only be made as he steps forward into the ball.

A preferred embodiment of a device for securing the wrists and elbows of the player comprises three elongated members, the first two being centered and pivotally mounted on the third and spaced apart a distance slightly less than that of the player's forearms. Each of the first two members can rotate in substantially the same plane about one of two parallel axes perpendicular to the axis of the third member. One of the first two members has at its two ends means for securing it to the player's wrists; and the other of the first two members has at its two ends means for securing it to the player's arms near the elbow. Illustratively, each of these securing means is a pair of Velcro (Reg. TM) brand straps.

BRIEF DESCRIPTION OF THE DRAWING

These and other objects, and features of the invention will become more readily apparent from the following detailed description of the embodiment in which.

DETAILED DESCRIPTION OF PREFERRED EMBODIMENT

Figure 1:
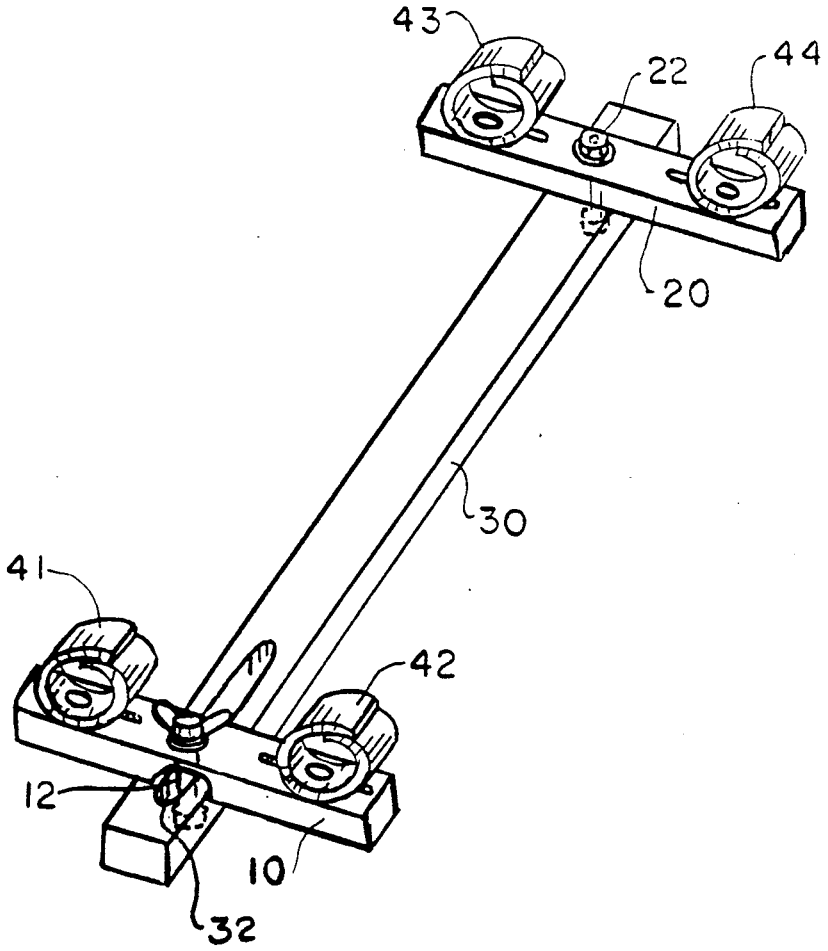
FIG. 1 is a perspective view of a preferred embodiment of the invention.

As shown in FIG. 1, a preferred embodiment of the present invention comprises first, second and third elongated members 10, 20 and 30, the first and second members being centered and rotatably mounted on the third member. The first and second members rotate in substantially the same plane about parallel axes 12, 22 which are spaced apart a distance slightly less than the player's forearm.

At each of the two ends of members 10 and 20, straps 41, 42, 43, 44 are mounted. Illustratively, straps 41 and 42 at the end of member 10 secure the player's wrists to that elongated member; and straps 43, 44 at the ends of member 20 secure the player's arms to that elongated member near the elbows. Advantageously, the straps are Velcro (Reg. TM) brand straps to permit quick securing and release but other types of straps or fastening devices may also be used.

When a player's wrists and arms are secured by this device, he is essentially forced to stand sideways to hit the tennis ball. At the same time, since the training device allows the player to shift the position of his left wrist and arm longitudinally and parallel to his right wrist and arm by rotating members 10 and 20 relative to member 30, the player is able to move his shoulders and upper body properly in swinging at the tennis ball. In particular, by stepping forward from a sideways position on the leg closer to the ball, the player is able to swing the racquet properly so as to hit the ball.

Figure 3:
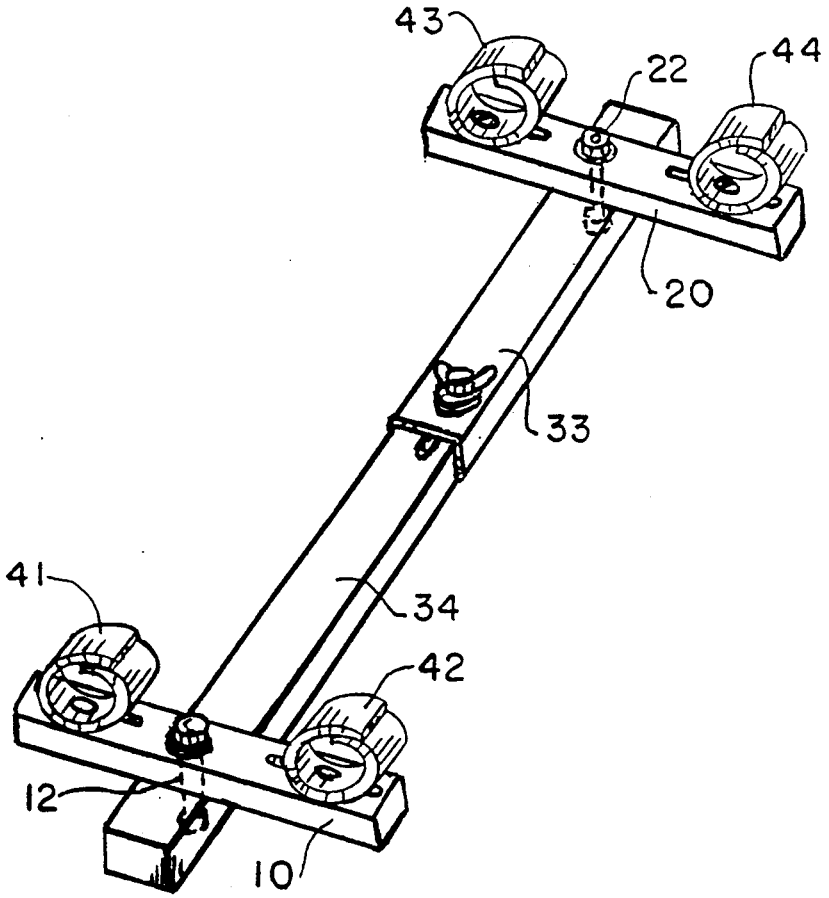

To permit use of the device by people of different size, means are provided for varying the distance between the points at which the first and second elongated members are secured to the third member. Such means illustratively is a slit 32 in member 30 and means such as a bolt and butterfly nut for securing one of members 10, 20 at the desired position along the slot. Alternatively, member 30 could be formed in two telescoping parts 33 and 34 as shown in FIG. 3 with means for securing the telescoping parts so that members 10, 20 are the desired distance apart.

Advantageously, the means for securing the wrists are positioned so as to hold the wrists about 4 inches (10 centimeters) apart; and the means for securing the arms are positioned so as to hold the arms about the same distance apart. Means may also be provided to vary the distance between the player's wrists and/or arms as, for example, by telescoping members 10 or 20 or by changing the point of attachment of the straps to members 10 and 20.

Numerous variations may be made in the device of the present invention. The elongated members may be made of all manner of materials but generally should be light-weight strong, and durable. These members may be fastened together by a variety of devices such as rivets, nuts and bolts, and the like, provided such devices permit the elongated members 10, 20 to rotate on member 30. A variety of devices can also be used to secure the player's wrist and arms to the elongated members.

Figure 2:
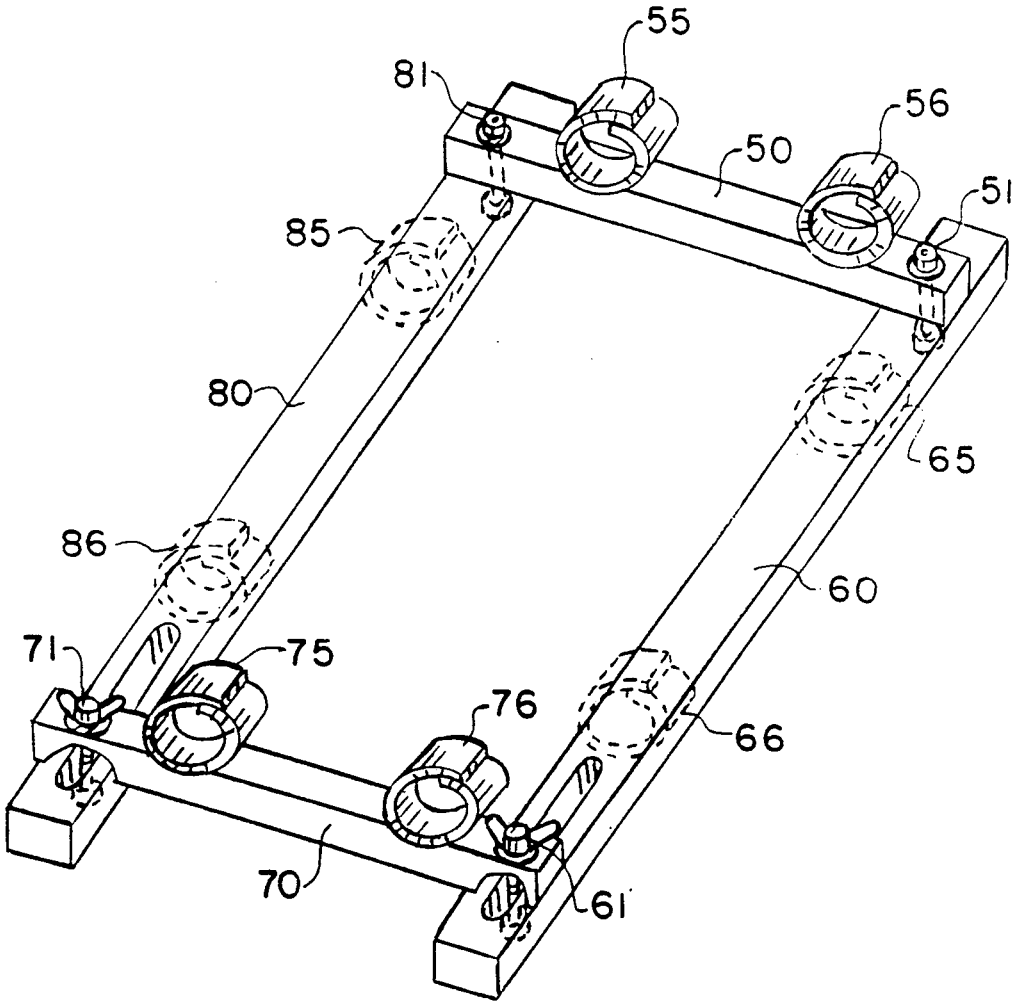
FIG. 2 is perspective view of an alternative embodiment of the invention and FIG. 3 is a perspective view of another embodiment of the invention.

Other arrangements of the elongated members and securing means can also be used. For example, as shown in FIG. 2, four elongated members 50, 60, 70, 80 can be connected by pivots 51, 52, 53, 54 at their extremities to form a parallelogram. In this case the means for securing the wrists and arms can be mounted either on the transverse members as shown by straps 55, 56 and 75, 76 or on the longitudinal members as shown in phantom by straps 65, 66 and 85, 86.

What is claimed is:

1. A sports training device for use by an individual player comprising:

first, second and third fixed elongated members, said first and second elongated members being pivotally mounted on said third elongated member at spaced-apart locations along a longitudinal axis of said third member such that they can pivot with respect to said third elongated member;

means mounted on said first elongated member for securing each of a player's wrists to said first elongated member; and means mounted on said second elongated member for securing each of a player's arms to said second elongated member, whereby the distance between the player's wrists and arms along said first and second elongated members is controlled to remain constant while the wrists and arms are allowed to shift parallel to each other and towards and away from the longitudinal axis of said third member.

2. The training device of claim 1 further comprising means for varying the distance between said first and second elongated members are mounted on said third elongated member.

3. The training device of claim 2 wherein said means for varying the distance is a slot in said third elongated member engaged by said pivot means of at least one of said first and second elongated members.

4. The training device of claim 1 wherein said means for securing the player's wrists are first and second fastening means mounted at spaced apart locations on said first elongated member and said means for securing the player's arms are third and fourth fastening means mounted at spaced-apart locations on said second elongated member.

5. The training device of claim 4 wherein the fastening means are hook and loop material.

6. The training device of claim 1 wherein said first and second elongated members are mounted on first and second axes, respectively said axes being mounted in said third elongated member so as to be substantially parallel whereby the first and second members pivot in substantially the same plane.

7. The training device of claim 6 wherein said first and second elongated members are centered on said third elongated member.

8. The training device of claim 7 wherein the first and second axes are each a bolt secured by a nut.

9. A sports training device for use by an individual player comprising:

first, second, third and fourth rigid elongated members, said first and second elongated members being pivotally mounted on said third and fourth elongated members at spaced-apart locations along longitudinal axes of said third and fourth members such that they can pivot with respect to said third and fourth elongated members; and means mounted on said first elongated member for securing each of a player's forearms to said first elongated member at spaced apart points thereon means mounted on said second elongated member for securing a players wrists at paced apart locations thereon, whereby the distance between the player's wrist and arms is controlled while the wrists and arms are allowed to shift relative to each other in a longitudinal direction.

10. The training device of claim 9 wherein said means for securing are hook and loop material.

* * * * *